United States Patent [19]

Roccaforte

[11] Patent Number: 5,007,542

[45] Date of Patent: Apr. 16, 1991

[54] RECLOSEABLE CARTON WITH POURING SPOUT

[76] Inventor: Harry I. Roccaforte, 3929 Forest Ave., Western Springs, Ill. 60558

[21] Appl. No.: 567,320

[22] Filed: Aug. 14, 1990

[51] Int. Cl.[5] ..... B65D 5/70

[52] U.S. Cl. ..... 206/621.6; 206/621.3; 206/626

[58] Field of Search ..... 206/621.3, 621.4, 621.6, 206/626, 631.2

[56] References Cited

U.S. PATENT DOCUMENTS

| | | | |
|---|---|---|---|
| 1,303,138 | 5/1919 | Woolwine . | |
| 2,819,832 | 1/1958 | Stoller et al. . | |
| 3,096,921 | 7/1963 | Graybill | 206/621.7 |
| 3,187,977 | 6/1965 | Graybill | 206/621.7 |
| 3,187,978 | 6/1965 | Graybill | 206/621.7 |
| 3,346,165 | 10/1967 | Koolnis . | |
| 3,372,853 | 3/1968 | Rumberger | 206/626 |
| 3,395,848 | 8/1968 | Johnson | 206/622 |
| 3,971,506 | 7/1976 | Roenna | 206/626 |
| 4,317,518 | 3/1982 | Mode | 206/621.4 |
| 4,577,762 | 3/1986 | Kuchenbecker | 206/626 |
| 4,718,557 | 1/1988 | Friedman | 206/621.3 |
| 4,732,315 | 3/1988 | Gunn | 229/125.09 |
| 4,809,853 | 3/1989 | Weber | 206/621.4 |
| 4,886,170 | 12/1989 | Willey et al. | 206/609 |
| 4,909,395 | 3/1990 | Weissman | 206/621.3 |
| 4,919,785 | 4/1990 | Willey et al. | 206/625 |

*Primary Examiner*—Gary E. Elkins
*Attorney, Agent, or Firm*—Dorsey & Whitney

[57] ABSTRACT

A carton for containing and protecting hygroscopic materials is provided and includes an integral pouring spout. The carton includes overlying end closure panels each having an array of partially penetrating cut lines on its inner and outer surfaces and cooperating perforations with through-cuts. A leader tab is provided on an outer end panel and an inner panel has a spout hole therein. The array of cut lines on the panels enables areas of delamination to be created, to lift a cover panel and expose the spout hole when the leader tab is pulled. The cover panel, the leader tab and a cut along the lead edge of the spout hole provide convenient reclosing of the carton. A flat blank for forming into the carton is also encompassed.

14 Claims, 4 Drawing Sheets

10
A
24
16
18
20
22
26
28
30
32
34
35
36
37
38
39
40
42
44
46
47
48
50
51
53
54
55
56
58
59
59'
59"
64
66
68
70
72
33

RECLOSEABLE CARTON WITH POURING SPOUT

TECHNICAL FIELD

The present invention relates to dispensing cartons and, more particularly, to a carton for containing materials requiring barrier protection wherein the carton is formed from a single piece blank and includes an easily openable and recloseable pouring spout.

BACKGROUND ART

Foldable, erectable paperboard cartons or containers have long been recognized as an inexpensive and efficient way to contain many materials for many purposes. Over the years, cartons have been provided with specific features depending on the use of the carton, both in terms of the material to be contained therein and in terms of handling the carton itself.

One area of prior work has been the development of cartons and material for forming cartons for containing hygroscopic material or other materials requiring a high degree of barrier, such as various soap powders, sweeteners or pancake mixes. This type of container is particularly adapted to prevent the absorption of moisture by the material contained in the carton and also to prevent leakage of the material, by having, for example, double thickness walls or films or other coatings applied to or integrated with the carton walls. Leakage can be a particular problem, because the materials are typically in powder or fine granulated form and as such, easily penetrate unsealed seams or perforated lines provided on the carton having cuts that penetrate completely through carton walls.

There have been attempts in the prior art to provide a container that addresses the above concerns. U.S. Pat. No. 4,732,315 discloses a recloseable dispensing package that has a plastic fitment mounted over a cutout area in one flap and an overlying closure flap. Another structure for forming a recloseable opening in a carton for containing a hygroscopic material is present in U.S. Pat. No. 4,718,557, wherein an outside panel may be opened to expose a weakened region that may be partially or fully severed from an inside panel. Also representative of the prior art is U.S. Pat. No. 1,303,138, which discloses a carton with a hinged flap that overlies pouring perforations in an inner flap.

U.S. Pat. No. 3,346,165 discloses an easy opening recloseable container including a dispenser for dispensing the contents. In particular, a portion of the container, severable along perforated lines to form a hinged flap, overlies an opening.

U.S. Pat. No. 2,819,832 discloses a leakproof carton having superimposed inside and outside spout openings. However, one problem unaddressed by this patent, as with other prior art cartons providing protection for material contained therein, is that a consumer has difficulty opening the carton because of the double, reinforced flap structures and the need to remove perforated material from two openings. Moreover, when double perforated flap structures are used, the material contained in the carton may still leak out and moisture may easily penetrate the carton, leading to contaminated contents, when the perforations are through cuts and cuts in separate layers are adjacent or superimposed. Thus, such prior art structures lack desired barrier qualities.

A carton having a double panel end closure with an opening flap in the outer panel providing access to a dispensing aperture in an inner panel is shown in U.S. Pat. No. 4,909,395. The opening structure includes a partially pre-cut bridge in the adhesive area for securing the outer flap to the inner panel. One problem with opening features of the type shown in the '165 and '395 patents is that coating materials or adhesives used between inner and outer panels may penetrate the perforations or scores or be inaccurately applied, thereby interfering with opening the carton. Also, cuts that run from the carton exterior to the inner opening can provide a path for moisture entry.

The use of paired, partial cuts, with one cut partially penetrating the package material from the inside and the other cut partially penetrating from the outside, is known as a means for forming frangible opening structures that have barrier qualities until torn. U.S. Pat. No. 4,809,853, discloses a package for containing dry, frangible products with a reclosable pouring opening. The opening/closure flap is defined by such paired, partial cuts into the material from which the carton is made. U.S. Pat. Nos. 4,886,170 and 4,919,785 disclose other cartons (not made to dispense materials by pouring) that include tear lines defined by cuts that partially penetrate the inner and outer surfaces of a top panel to define a delaminating tear area therebetween.

Despite the above-cited prior art, there remains a need for a carton for packaging powdered materials that prevents leakage and provides barrier protection for the material contained in the carton, while at the same time providing a pour spout that is easy for a consumer to open.

SUMMARY OF THE INVENTION

Accordingly, the present invention provides an opening structure for a carton containing products requiring a high degree of barrier protection from moisture and other contaminants, yet which enables a consumer to have easy access to the product and to reclose the carton after the initial opening.

The carton incorporating the inventive opening structure is generally tubular, having a material receiving central cavity formed by side and end walls. One set of end walls has an inner end wall panel having a spout hole opening precut into that panel and also includes an overlying outer end wall panel having a plurality of superficial, parallel, partial cut lines in the inside and outside surfaces thereof. The cut lines define tear areas for a cover flap having a leader portion so the consumer may easily grasp the cover flap to pull the flap away from the inner end panel with the hole, thereby exposing the hole so that the material may be dispensed therethrough. After use, the leader portion of the cover flap conveniently and securely may be used to lock the cover flap over the spout hole. The invention also encompasses a flat, die cut blank for forming into the package.

An object of the present invention is to provide a package, and a blank for forming the package, whereby materials susceptible to contamination may be contained therein with little danger of becoming contaminated, yet a purchaser can easily manipulate the package opening structure to dispense the contents and conveniently and easily reclose the package.

Other objects of the present invention are: to provide an easily openable container for powdered materials that avoids perforated score lines where leakage of the material might occur; to provide a package wherein complicated, difficult to manipulate, expensive films or inserts for closing the container or sealing the opening in the container to maintain product integrity are not required; to provide a two-layer wall panel structure containing a tearable opening structure; and to provide a container that does not require multiple steps for opening.

Important advantages of the present invention are that it combines specific shipping and packaging advantages, such as reduced contamination and leakage of material contained therein, with specific point of use advantages, such as enhanced ease of opening and closing.

Other objects and advantages of the present invention will become more fully apparent and understood with reference to the following specification and to the appended drawings and claims.

DETAILED DESCRIPTION OF THE PREFERRED EMBODIMENT

Figures 1, 9:
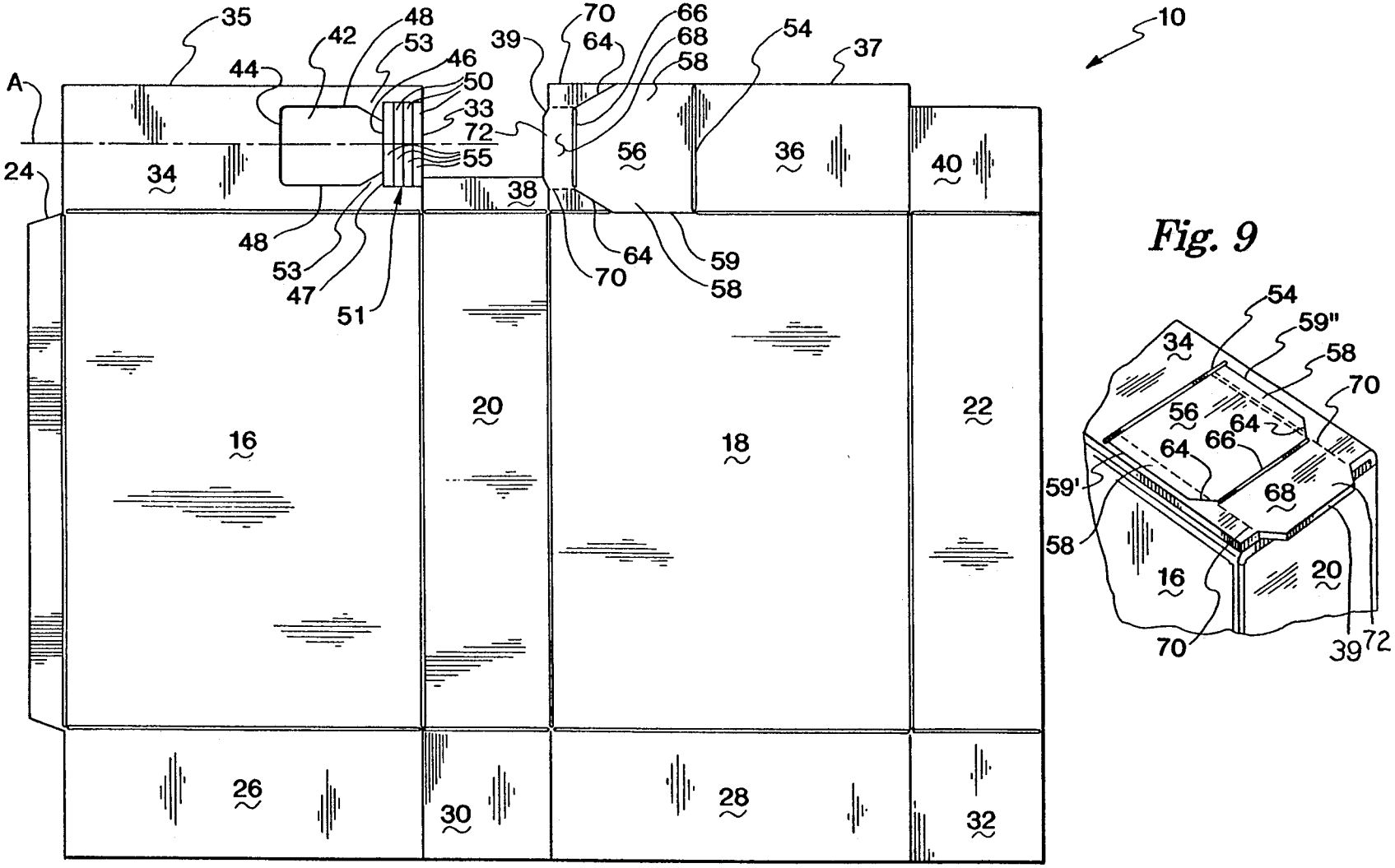
FIG. 1 is a top plan view of the outside surface of the blank from which the carton of the present invention is formed and shows the die cut profile thereof.
FIG. 9 is a fragmentary perspective view of the spout-bearing end of the present invention showing an alternative location of the cuts forming the cover flap.
Figure 3:
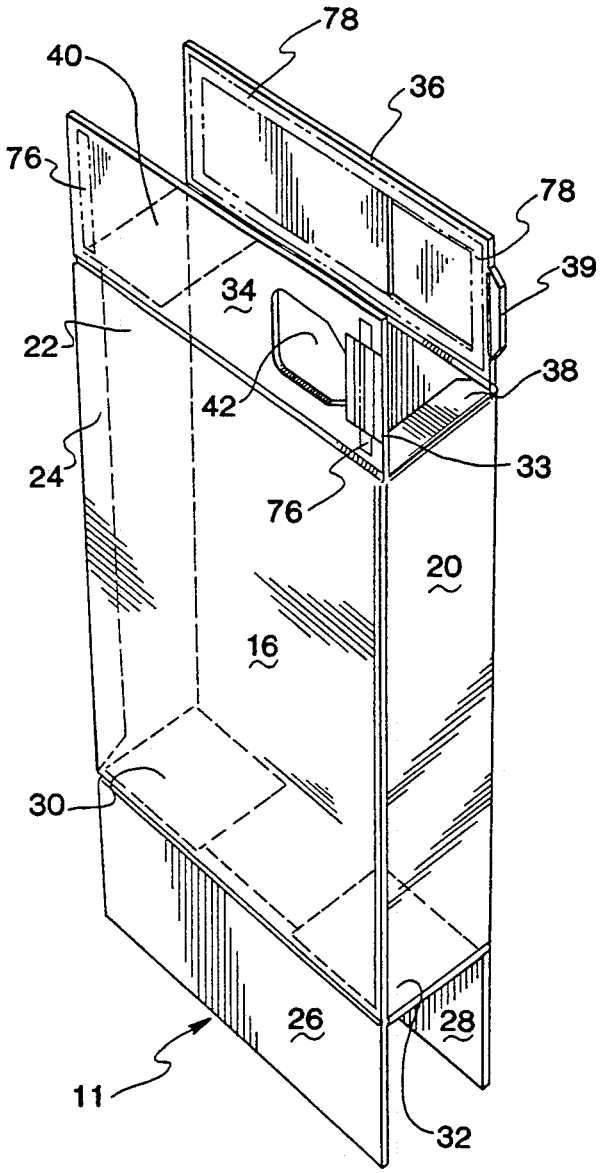
FIG. 3 is a perspective view depicting partial erection of the carton.
Figure 4:
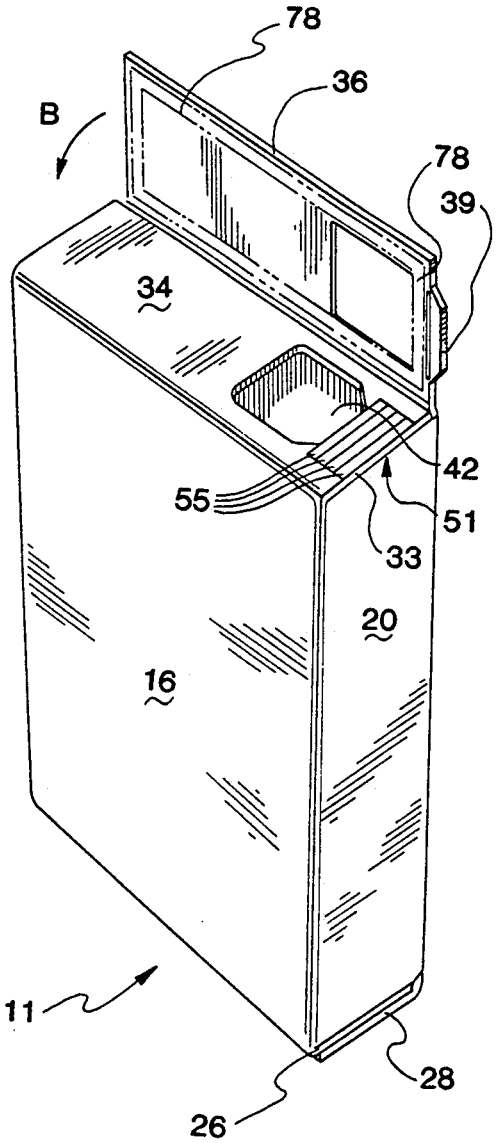
FIG. 4 is a perspective view of an erected carton showing the spoutbearing end just before final closure and showing how the bottom end portion of the carton is configured after the carton is filled.

FIG. 1 depicts the outside surface of a blank 10 for forming, in accordance with the present invention, a carton 11 as depicted in FIGS. 3 and 4. The carton 11 comprises a generally tubular body defining a cavity therein, the body being formed by opposed, parallel front and rear panels 16, 18; opposed, parallel side panels 20, 22; and top and bottom end-closure walls, each made from a set of cooperating overlapping end panels.

The blank is formed by die cutting and scoring paperboard or other similar sheet material. In the drawings, the double lines indicate fold score lines, usually provided to foldably interconnect various panels. Single, unbroken lines depict cuts that extend through or partially through the panels or depict free edges of the panels. Single, broken lines depict perforated score lines.

As best seen in FIG. 1, the side panels 20, 22 and front and rear panels 16, 18 are joined at parallel main body fold lines. A glue flap 24 is provided at a further parallel main body fold line along one edge of front panel 16 to secure the carton 11 in its generally tubular erected configuration.

Figure 2:
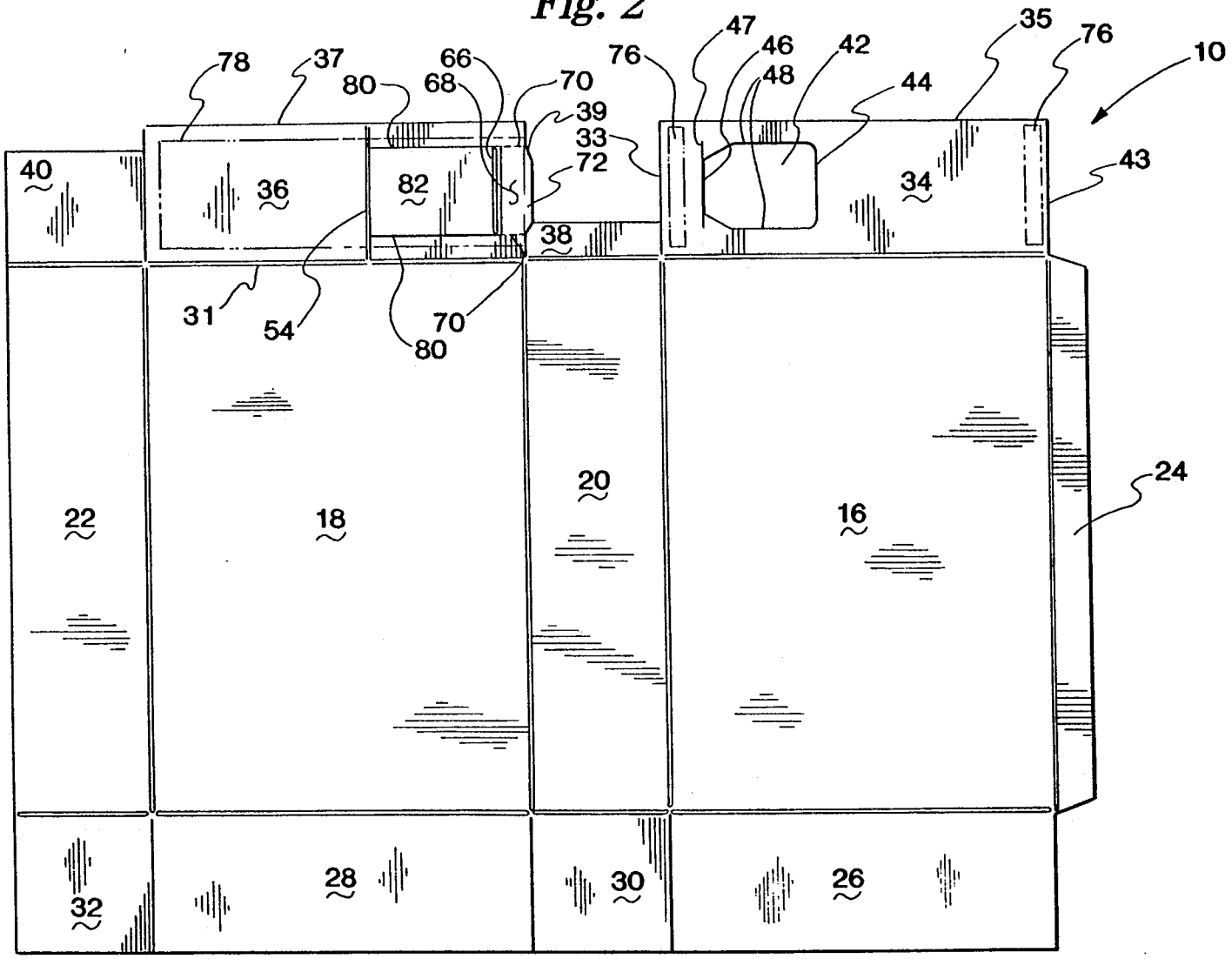
FIG. 2 is a top plan view of the inside surface of the blank from which the carton of the present invention is formed and shows the die cut profile thereof.

Major bottom end panels 26, 28 and minor bottom end panels 30, 32 are joined to the lower edges of panels 16, 20, 18 and 22 as shown in FIG. 1. Major top end panels 34 (inner panel), 36 (outer panel) and minor top end panels 38, 40 are joined to the upper edges of panels 16, 20, 18 and 22 as shown in FIG. 1. The fold lines joining bottom end panels 26, 30, 28, 32 to panels 16, 20, 18 and 22 are parallel to the main body fold lines joining top end panels 34, 38, 36 and 40 and perpendicular to the fold lines joining panels 16, 20, 18 and 22. It should be appreciated that, as depicted in FIGS. 1 and 2, the major top end panels 36, 34 have free outside edges 37, 35, respectively, opposite and parallel to the fold lines attaching these panels to panels 18, 16, respectively. Major top end panels 34, 36 also have free front edges 33, 39, respectively.

The major top inner panel 34 is provided with a spout hole or opening 42. The spout hole 42 is generally centered on the central longitudinal axis A of the panel 34 (see FIG. 1) and closer to one end of the panel 34 than the other. The spout hole 42 has a rear edge 44, a front edge 46 opposite the rear edge, and opposed side edges 48. As best seen in FIG. 1, between the front edge 33 of the panel 34 and the front edge 46 of the hole 42, the outside surface of panel 34 has a plurality of transverse parallel, superficial incisions 50. The incisions penetrate 30% to 60% of the panel thickness and form a lead delamination area 51 lying between front edges 33 and 46 and comprising a plurality of delamination ribs 55 between the incisions 50. The side edges 48 of the spout hole 42 taper or angle inwardly toward one another near the front edge 46 of the hole 42 and the delamination area 51, thereby forming opposed support corners 53. It should be noted that the cut line 47 at front edge 46 extends for a short distance into each of the tapered areas near the front edge 46, so that the length of the cut line 47 at the front edge 46 is approximately equal to the width of the hole 42 away from the tapered area.

Further reference to FIG. 1 indicates that the major top outer end panel 36 includes a first transverse fold score line 54. The line 54 extends substantially across the surface of panel 36 perpendicular to edge 37. A cover flap 56 is provided between the front edge 39 of panel 36 and the first transverse fold score line 54. The cover flap 56 has a leader tab 68 at front edge 39 separated from the remainder of the cover flap 56 by a second transverse fold score line 66. The longitudinal edges of cover flap 56 (edges perpendicular to first and second transverse fold score lines 54, 66) are defined by two parallel tear areas 58 extending approximately from the second transverse fold line 66 to the first transverse fold line 54.

As seen in FIG. 1, the outer boundary of tear area 58 on one side of the cover flap 56 is formed primarily by the outside free edge 37 and the outer boundary of tear area 58 on the other side is formed by a cut line 59. The cut line 59 is a cut that partially (30% to 60%) penetrates the blank 10 along the fold line connecting the panel 36 to the side panel 18. A tapering of the tear areas 58 is created where a pair of cut lines 64, also partially penetrating the blank 10, angle or converge toward one another, one line 64 extending from the free edge 37 and the other from cut line 59. Between the tips of the tapered portions of tear areas 58 on the cover flap 56, the second transverse fold score line 66 is located.

As noted previously, the second fold score line 66 defines one boundary of a leader tab 68. Two parallel side edges of the leader tab 68 are defined by parallel, perforated tear lines 70 that extend at right angles from the second fold score line 66 in the direction of front edge 39. At the front edge 39 the leader tab 68 extends outwardly beyond what would otherwise be a straight front edge of panel 36, thereby forming a finger edge or lifting extension 72. (Alternatively, finger edge/lifting extension 72 can be formed by making front edge 39 straight and recessing front edge 33 slightly, so that when the carton 11 is erected as in FIG. 4, the front edge 39 extends out over edge 33.)

FIG. 2 depicts a plan view of the inside surface of the blank 10 and has reference characters in common with FIG. 1. FIG. 2 also presents additional details regarding the major top end panels 34, 36. Specifically, glue areas 76 are indicated at both the front edge 33 and the opposed rear edge 43 of major top inner end panel 34. The major top outer end panel 36 has glue area 78, which, in the preferred embodiment, extends substantially continuously around the panel 36 just inside the perimeter thereof.

The inside surface of the major top outer end panel 36 is provided with a pair of parallel, partial (30% to 60% of panel thickness) cuts or incisions 80. The cuts 80 define on the inside surface of the panel 36 the inner boundaries of the tear areas 58 on either side of the cover flap 56. The area 82 within these inner boundaries has substantially the same width as the spout hole 42 in the major top inner end panel 34. The partial cut lines or incisions 80, 80 extend from the first transverse score line 54 toward the front edge 39 (where that edge forms the finger edge or lifting extension 72), stopping at the second transverse fold line 66 near where lines 64 converge at the same score line 66; the lines/incisions 80, 80 also lie inside and spaced from the free edge 37 and cut line 59 of the major top outer end panel 36. Each line-/incision 80 is substantially collinear with one of the perforated tear lines 70 defining the side edges of leader tab 68.

While FIGS. 1 and 2 show a preferred configuration, if a different size dispensing opening for a carton is desired, the size of the spout hole 42 may be reduced or enlarged. Partial cuts/incisions 80, 80 in the inside of panel 36 and the partial cuts 59, 64, 64 on the outside of the panel 36 may be moved inwardly toward or outwardly away from one another to correlate to the width of the hole 42.

Figure 5:
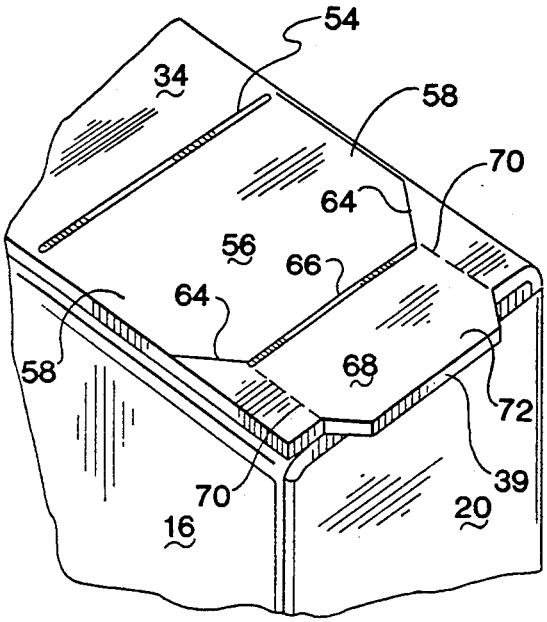
FIG. 5 is a fragmentary perspective view of the spout bearing end of a fully erected and filled carton.

FIGS. 3, 4 and 5 are commonly numbered with FIGS. 1 and 2 and depict the carton 11 of the present invention in various stages of erection. Specifically, in FIG. 3, the carton 11 has been formed into its generally tubular erected shape and the glue flap 24 has been glued to the inside of side panel 22. The minor top end panels 38, 40 have been folded inwardly and glue is applied to glue areas 76, 76, 78 on the panels 34, 36. (In this condition it can be seen that the length of minor top end panel 38 is such that it extends under the delamination area 51 but will reach no further than front edge 46.) In FIG. 4, the major top inner end panel 34 has been folded inwardly and the major top outer end panel 36 is ready to be folded inwardly and downwardly (as indicated by arrow B) to overlie the major top inner end panel 34, whereby the cover flap 56 and, specifically, the area 82 between tear areas 58 is brought into alignment with the spout hole 42. The carton 11 may be filled from the open top end depicted in FIG. 3 before inward folding of panels 34, 36. If this is done, the major bottom end panels 26, 28 will have been folded inwardly onto the previously inwardly folded minor bottom end panels 30, 32, with all panels secured in place by suitable glue or adhesive. Alternatively, the carton 11 may be filled from the open bottom end (as depicted in FIG. 3) if the top end is closed and sealed first.

FIG. 5 shows a detailed view of the opening structure of the present invention when panel 36 has been affixed on top of panel 34. As can be seen, the cover flap 56, including leader tab 68, extends from finger edge or lifting extension 72, which extends outward from side panel 20, back to first transverse fold score line 54. Spout hole 42 is covered and sealed, in that it is surrounded by adhesive 78 and no through-cut path exists to provide access to hole 42. The through cuts in perforated tear lines 70, 70 lead only to the surface of delamination ribs 55 in the delamination area 51. The incisions 50 forming the ribs 55 are transverse, aligned approximately parallel to the adjacent lead edge 46 of the hole 42, and do not lead from finger edge 72 to the spout hole 42, nor do they extend through the panel 34 to the interior of the carton 11. In an alternative embodiment, the bead of adhesive running along the fold line 31 at the edge of the panel 36 opposite edge 37 is omitted. While this bead of adhesive helps "caulk" the edge 35 when the panel 36 is folded onto panel 34, where a lesser degree of barrier can be tolerated, the combination of a U-shaped glue bead and the carton material at the fold line 31 between the panels 18 and 36 is sufficient barrier.

Figure 6:
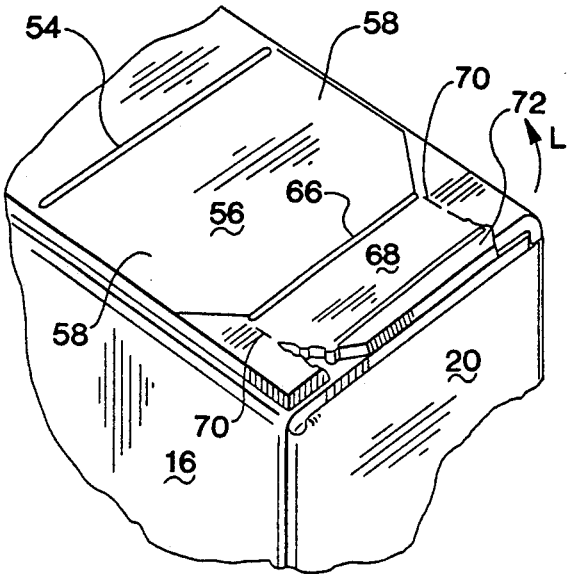
FIG. 6 is a fragmentary perspective view of the present invention partially opened.
Figure 7:
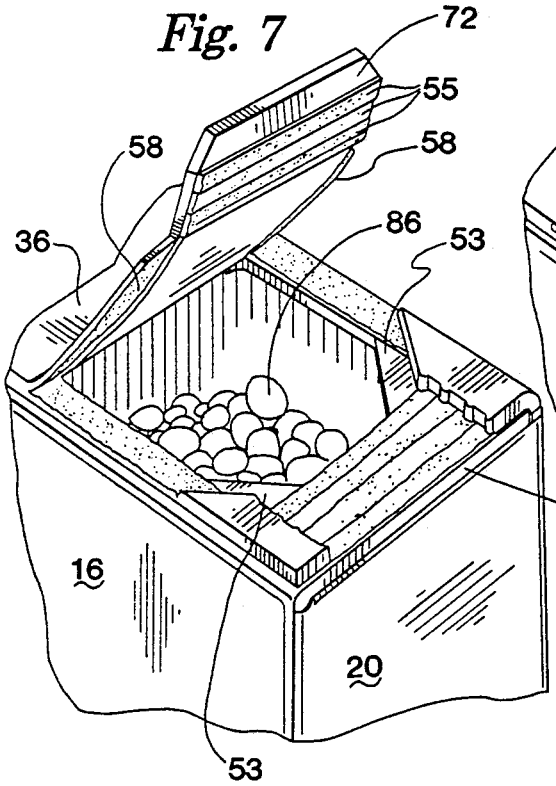
FIG. 7 is a fragmentary perspective view of the present invention as it might appear after being fully opened by a consumer.
Figure 8:
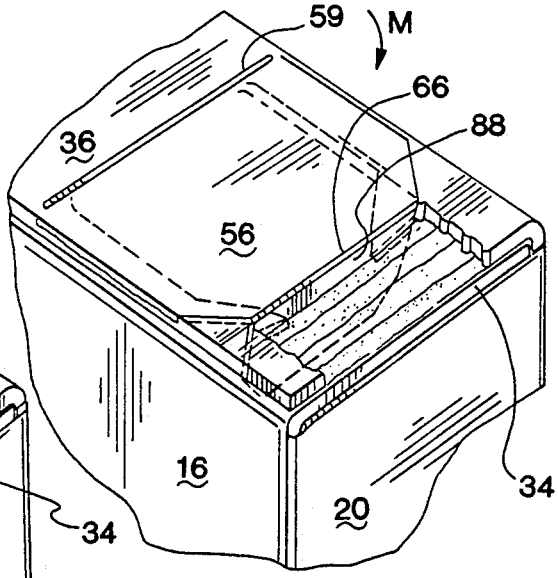
FIG. 8 is a fragmentary perspective view of the spout-bearing end of the present invention as it may appear following the reclosing of the spout.

FIGS. 6, 7 and 8 depict the carton 11 in various conditions during opening and use by a consumer. FIG. 6 illustrates how the finger edge 72 and leader tab 68, subjected to an upward force, indicated by line or arrow L, are used to begin a tearing or severing along perforated tear lines 70. At this point, the carton 11 is still sealed, because a portion of the glue area 78 still overlies the incisions 50; however, part of delamination ribs 55 of the major top inner end panel 34 has started to tear away, beginning delamination in the delamination area 51.

FIG. 7 depicts the effect of continued lifting force (in the direction of the arrow L) exerted by the user on leader tab 68. The delamination area 51 is now fully delaminated; all ribs 55 adjacent the front transverse score line 54 are removed and remain attached to the inner surface of leader tab 68 as a result of serial or sequential delamination of the ribs 55 between the transverse incisions 50. Along the pair of parallel tear areas 58,58 of cover flap 56, defined in part by the partial cuts 80 on the inside of the major top outer end panel 36, the continued lifting of the leader tab 68 results in parallel delamination regions adjacent and above the side edges 48 of the spout hole 42. Support corners 53 are uncovered. They provide a narrowing of the spout hole 42 whereby the flow of product 86 may be more easily directed by the consumer as pouring takes place. The first transverse fold score line 54 aids folding the cover flap 56 back upon the panel 36 so that it will not interfere with the dispensing of the product 86.

FIG. 8 depicts reclosure of the cover flap 56 following dispensing of product 86 by the consumer. Specifically, a special function of the leader tab 68 is shown. From the position shown in FIG. 7, for reclosure the leader tab 68 is folded and rotated downwardly along the second transverse fold score line 66 and directed into the full cut 47 extending along the front edge 46 of spout hole 42 between the support corners 53 at one edge of the delamination area 51. Continued force (in the direction of arrow M) rotates the cover flap 56 about the first transverse fold score line 54 until the surfaces separated by delamination in the tear areas 58 of panel 36 are back in contact with each other, thereby reclosing the container 11. It should be noted that the distance between the first and second transverse score fold lines 54, 66 is slightly greater than the distance between the second transverse score fold line 54 and the full cut 47 at edge 46. Accordingly, the leader tab 68 has to be inserted at an acute angle relative to the remainder of cover flap 56. Thus, upon insertion of the leader tab 68 for reclosure, a recess area 88 is formed just below the second transverse fold line 66, so that a user may easily insert a finger into the recess 88 to reopen the carton.

A number of variations of the present invention can be made. For example, the size of the spout hole 42 may be changed and the superficial or penetrating cuts on the inside and outside of the major top outer panel 36 and the outside of major top inner panel 34 may be adjusted accordingly so that any size dispensing spout may be provided. Thus, as depicted in the drawings, the fold score line connecting panel 36 to side panel 18 may incorporate the partially penetrating cut line 59, with free edge 37 forming the corresponding outer boundary of the tear area 58 of the other side of the cover flap 56. Alternatively, as seen in FIG. 9, the tear areas 58 of cover flap 56 may be located inwardly of the side edges of the panel 36 by moving cut line 59 inward to line 59' and placing a corresponding cut line 59'' inboard of edge 37. While the position of the spout for the carton 11 has been depicted at or near one end of the top wall of rectangular carton 11, the spout might be located where convenient elsewhere on the same top end-closure wall, or on another wall having a closure structure using two overlapping panels or on a nonrectangular carton having a closure structure having two overlapping panels. While the spout hole 42 is shown as a generally rectangular hole, it is within the scope of the present invention that the spout hole 42 might be round or oblong or have another shape.

The material from which the present invention is fabricated may be of paperboard or any suitable stiff but still flexible sheet material and, in fact, the carton 11 may be formed from sheet plastics or other similar materials. Additionally, any paperboard used may be coated with various substances to impart desirable characteristics thereto such as greater resistance to liquids. The present invention is particularly advantageous in these coated paperboard situations, because manipulation of the cover flap 56 causes delamination in areas 51 and 58 to occur based on pre-cut lines. Thus, a user is not required to tear through coating material. For further sealing, the carton 11 may be overwrapped with any thermoplastic film or other suitable material. Both the interior and the exterior of the carton 11 may be marked with appropriate indicia and may be provided with other features to facilitate the handling, transportation and retailing of the carton and the product therein.

It should be understood that as an alternative to assembling the carton 11 as shown in FIG. 3, the producer of the carton may provide the carton 11 in blank 10 form, in a completely flat, unerected condition. Thus, the purchaser of the carton 11 of the present invention has the option of how to purchase; if the blank 10 is purchased in a flat condition, instructions may be provided about how to form the carton 11 for receiving contents.

Although the description of the preferred embodiment has been presented, it is contemplated that various changes, including those mentioned above, could be made without deviating from the spirit of the present invention. It is desired, therefore, that the present embodiment be considered in all respects as illustrative, not restrictive, and that reference be made to the appended claims rather than the foregoing description to indicate the scope of the invention.

What is claimed and desired to be protected by Letters Patent is:

1. A recloseable pouring spout structure for a wall of a carton comprising:

an outer wall panel having inner and outer surfaces and a leader tab therein defined by a pair of parallel tear lines of substantially equal length formed by intermittent cuts through the outer wall panel, each tear line having a first end and a second end, said leader tab further having a finger edge connecting the first ends of said tear lines;

first and second tear areas of substantially equal length formed in said outer wall panel, each said tear area having a first end that adjoins one of the second ends of one of the tear lines and a second end, each said tear area being defined by a partial cut in the inner surface of the outer wall panel and a partial cut in the outer surface of said outer wall panel substantially parallel to and displaced from the partial cut in the inner surface, each of said tear areas extending from its first end to its second end in a direction generally the same as the direction in which the tear lines extend;

an inner wall panel having inner and outer surfaces and a spout opening therethrough with a lead edge, said outer surface of the inner wall panel lying against and affixed to the inner surface of the outer wall panel by adhesive means that substantially encircles the spout opening and extends across the inner surface of the outer wall panel at the leader tab, such that the spout opening is located substantially between the first and second tear areas; and a plurality of parallel, transverse, delamination ribs formed by partial cuts in the outer surface of the inner wall panel adjacent the lead edge of the spout opening, said transverse delamination ribs being located below the inner surface of the leader tab, such that said transverse delamination rib partial cuts are oriented substantially at right angles to the direction of extent of the tear lines and extend substantially between the tear lines and such that the outer surface of at least one of the transverse delamination ribs is affixed to the inner surface of the leader tab by said adhesive means.

2. The carton structure of claim 1 wherein the outer wall panel has perimeter edge and the finger edge coincides with the perimeter edge.

3. The carton structure of claim 1 wherein a first fold score line extends between the second ends of the tear areas.

4. The carton structure of claim 3 wherein a second fold score line extends between the second ends of the tear lines.

5. The carton structure of claim 4 wherein the distance between the first and second fold score lines exceeds the distance between the first fold score line and the lead edge.

6. The carton structure of claim 1 wherein the partial cuts forming each of the tear areas in the inner and outer surfaces of the outer wall panel converge toward each other adjacent the first end of each of said tear areas.

7. The carton structure of claim 1 wherein the distance between the tear area partial cuts in the inner surface of the outer wall panel is less than the distance between the tear area partial cuts in the outer surface of the outer wall.

8. A recloseable pouring spout structure for an end-closure of a rectangular carton comprising:

an outer end-closure panel affixed to a first wall panel of the carton at a first end-panel fold line, said outer end-closure panel having inner and outer surfaces and a leader tab therein defined by a pair of parallel tear lines of substantially equal length formed by intermittent cuts through the outer end-closure wall panel, each tear line having a first end and a second end, said leader tab further having a finger edge connecting the first ends of said tear lines;

first and second tear areas of substantially equal length formed in said outer end-closure panel, each said tear area having a first end that adjoins one of the second ends of one of the tear lines and a second end, each said tear area being defined by a partial cut in the inner surface of the outer end-closure panel and a partial cut in the outer surface of said outer end-closure panel substantially parallel to and displaced from the partial cut in the inner surface, each of said tear areas extending from its first end to its second end in a direction generally the same as the direction in which the tear lines extend;

an inner end-closure panel affixed to a second wall panel of the carton at a second end-panel fold line parallel to and spaced from the first end-panel fold line, said inner end-closure panel having inner and outer surfaces and a spout opening therethrough with a lead edge, said outer surface of the inner end-closure panel lying against and affixed to the inner surface of the outer end-closure panel by adhesive means in a U-shaped configuration that combines with the first end-panel fold line to substantially encircle the spout opening, said adhesive means extending across the inner surface of the outer end-closure panel at the leader tab, such that the spout opening is located substantially between the first and second tear areas; and a plurality of parallel, transverse, delamination ribs formed by partial cuts in the outer surface of the inner end-closure panel adjacent the lead edge of the spout opening, said transverse delamination ribs being located below the inner surface of the leader tab, such that said transverse delamination rib partial cuts are oriented substantially at right angles to the direction of extent of the tear lines and extend substantially between the tear lines and such that the outer surface of at least one of the transverse delamination ribs is affixed to the inner surface of the leader tab by said adhesive means.

9. The carton structure of claim 8 wherein the outer end-closure panel has perimeter edge and the finger edge coincides with the perimeter edge.

10. The carton structure of claim 8 wherein a first fold score line extends between the second ends of the tear areas.

11. The carton structure of claim 10 wherein a second fold score line extends between the second ends of the tear lines.

12. The carton structure of claim 11 wherein the distance between the first and second fold score lines exceeds the distance between the first fold score line and the lead edge.

13. The carton structure of claim 8 wherein the partial cuts forming each of the tear areas in the inner and outer surfaces of the outer wall panel converge toward each other adjacent the first end of each of said tear areas.

14. The carton structure of claim 8 wherein the distance between the tear area partial cuts in the inner surface of the outer wall panel is less than the distance between the tear area partial cuts in the outer surface of the outer wall.

* * * * *